US012290171B2

(12) United States Patent
Neuhaus et al.

(10) Patent No.: US 12,290,171 B2
(45) Date of Patent: May 6, 2025

(54) TELESCOPIC RAIL

(71) Applicant: Accuride International GmbH, Diez (DE)

(72) Inventors: Christoph Neuhaus, Niederelbert (DE); Christian Satony, Urbar (DE)

(73) Assignee: ACCURIDE INTERNATIONAL GMBH, Diez (DE)

( * ) Notice: Subject to any disclaimer, the term of this patent is extended or adjusted under 35 U.S.C. 154(b) by 0 days.

(21) Appl. No.: 17/919,610

(22) PCT Filed: May 26, 2021

(86) PCT No.: PCT/EP2021/063953
§ 371 (c)(1),
(2) Date: Oct. 18, 2022

(87) PCT Pub. No.: WO2021/244907
PCT Pub. Date: Dec. 9, 2021

(65) Prior Publication Data

US 2023/0337820 A1 Oct. 26, 2023

(30) Foreign Application Priority Data

Jun. 5, 2020 (EP) ..... 20178409

(51) Int. Cl.
*A47B 88/493* (2017.01)
*A47B 88/457* (2017.01)
*A47B 88/46* (2017.01)

(52) U.S. Cl.
CPC ..... *A47B 88/493* (2017.01); *A47B 88/457* (2017.01); *A47B 88/46* (2017.01)

(58) Field of Classification Search
CPC ..... A47B 88/493; A47B 88/457; A47B 88/46; A47B 88/447; A47B 88/44
See application file for complete search history.

(56) References Cited

U.S. PATENT DOCUMENTS 2,267,043 A * 12/1941 Premo ..... A47B 88/493 312/331
11,202,504 B2 12/2021 Kim
(Continued)

FOREIGN PATENT DOCUMENTS

CN 108916226 A 11/2018
DE 20308256 U1 * 6/2004 ..... A47B 88/457
WO WO-2009012507 A1 * 1/2009 ..... A47B 88/457

OTHER PUBLICATIONS

English translation of DE 20308256 U1 (Year: 2023).*
(Continued)

*Primary Examiner* — Daniel J Rohrhoff
(74) *Attorney, Agent, or Firm* — PAUL & PAUL

(57) ABSTRACT

According to the invention, a telescopic rail is proposed, having a first rail element, a second rail element, a third rail element, and a drive device, wherein the first rail element and the second rail element are mounted together such that the first rail element and the second rail element are linearly displaceable relative to one another in and counter to a pull-out direction, wherein the third rail element and the second rail element are mounted together such that the third rail element and the second rail element are linearly displaceable relative to one another in and counter to the pull-out direction, wherein the drive device is mounted on the first rail element or is mountable on a holding element connectable to the first rail element, wherein the drive device is configured such that, in an operation of the telescopic rail, the drive device causes a linear movement of the second rail element relative to the first rail element in or counter to the pull-out direction, wherein the telescopic rail comprises a traction element, wherein the traction element is fixed to the first rail element and to the third rail element, and wherein the traction element is guided on the second rail element in a direction parallel to the pull-out direction such that a
(Continued)

displacement movement of the second rail element relative to the first rail element leads to a displacement movement of the third rail element relative to the second rail element.

26 Claims, 6 Drawing Sheets

(56) References Cited

U.S. PATENT DOCUMENTS

| | | | | |
|---|---|---|---|---|
| 11,927,216 | B2 | 3/2024 | Zou et al. | |
| 2010/0219727 | A1* | 9/2010 | Aguilar Ante | A47B 88/447 312/319.1 |
| 2020/0345139 | A1 | 11/2020 | Kim | |
| 2021/0010574 | A1* | 1/2021 | Lee | H02K 7/1166 |
| 2021/0199155 | A1* | 7/2021 | Zou | F16C 29/04 |
| 2023/0180931 | A1* | 6/2023 | Xi | A47B 88/457 312/408 |

OTHER PUBLICATIONS

Agnes Wittmann-Regis, The International Bureau of the World Intellectual Property Organization, International Preliminary Report on Patentability, Date of Report: Dec. 6, 2022, PCT/EP2021/063953 (English translation).

Examiner Man Qu, Office Action Dated Jan. 15, 2025, Chinese Application No. 202180038781.1.

* cited by examiner

TELESCOPIC RAIL

CROSS-REFERENCE TO RELATED APPLICATIONS

This application is a national phase application of International Application PCT/EP2021/063953, filed May 26, 2021, and claims the priority of European Application EP20178409.7, filed on Jun. 5, 2020.

The present invention relates to a telescopic rail having a first rail element, a second rail element, a third rail element, and a drive device, wherein the first rail element and the second rail element are mounted together such that the first rail element and the second rail element are linearly displaceable relative to one another in and counter to a pull-out direction, wherein the third rail element and the second rail element are mounted together such that the third rail element and the second rail element are linearly displaceable relative to one another in and counter to the pull-out direction, wherein the drive device is mounted on the first rail element or is mountable on a holding element connectable to the first rail element, and wherein the drive device is configured such that, in an operation of the telescopic rail, the drive device causes a linear movement of the second rail element relative to the first rail element in or counter to the pull-out direction.

Telescopic rails having two or more rail elements and a guide between respective two rail elements are known in various embodiments from the prior art. In many telescopic rails, the guide between two respective rail elements is realized in the form of a rolling element cage. Here, rolling elements are received in the rolling element cage in order to reduce the friction between the rail elements during a pull-out movement. Telescopic rails are used in various household appliances, but also in automotive construction, furniture construction, and in many other applications.

In an increasing number of applications, users demand supported or fully automated handling when performing a pull-out action. Telescopic rails with a power support, for example in the form of a resilient pretensioning of one rail element relative to another, are therefore known. Motor-driven telescopic rails are also known, in which the displacement movement of one rail element relative to another rail element is caused by an electric drive.

In such power-assisted or motor-powered telescopic rails, it is disadvantageous that they are either only available for telescopic rails having exactly two rail elements, which then mandatorily only form partial pull-outs, or require a very high design effort. The higher design effort usually also requires a larger installation space and/or higher production costs. Further, the known drives require a complex integration into already existing designs of the rail elements.

By contrast, it is a problem of the present invention to provide a telescopic rail that allows power-assisted or motor-driven pull-out or push-in movement of three or more rail elements of a telescopic rail. In addition, it is a problem of the invention to provide such a telescopic rail that can operate with a small number of components. Further, it is a problem of the present invention to provide such a telescopic rail that is cost-efficient to manufacture. In addition, it is a problem to provide a telescopic rail that has the lowest possible design space. Furthermore, a telescopic rail with good integration of the drive into already existing designs of the rail elements is to be created.

At least one of the aforementioned problems is solved according to the invention by a telescopic rail having a first rail element, a second rail element, a third rail element, and a drive device, wherein the first rail element and the second rail element are mounted together such that the first rail element and the second rail element are linearly displaceable relative to one another in and counter to a pull-out direction, wherein the third rail element and the second rail element are mounted together such that the third rail element and the second rail element are linearly displaceable relative to one another in and counter to the pull-out direction, wherein the drive device is mounted on the first rail element or is mountable on a holding element connectable to the first rail element, wherein the drive device is configured such that, in an operation of the telescopic rail, the drive device causes a linear movement of the second rail element relative to the first rail element in or counter to the pull-out direction, wherein the telescopic rail comprises a traction element, wherein the traction element is fixed to the first rail element and to the third rail element, and wherein the traction element is guided on the second rail element in a direction parallel to the pull-out direction such that a displacement movement of the second rail element relative to the first rail element leads to a displacement movement of the third rail element relative to the second rail element.

The basic idea of the present invention is to provide, with the aid of a traction element, a coupling of a push-in or pull-out movement in or counter to the pull-out direction of the third rail element relative to the second rail element to a push-in or pull-out movement of the second rail element relative to the first rail element. The coupling of the two push-in or pull-out movements according to the invention is space-saving in one embodiment and inexpensive in one embodiment.

Central to the function of the traction element is that it is fixed to both the first rail element and the third rail element and is also guided to the second rail element. In this way, a movement of the third rail element relative to the second rail element is coupled to a movement of the second rail element relative to the first rail element.

The pull-out direction within the meaning of the present application refers to the possible direction of movement of a rail element relative to another rail element from a pushed-in position into a pulled-out position. The push-in movement takes place counter to the pull-out direction.

A relative movement between two rail elements in the pull-out direction is referred to as a pull-out movement, and a relative movement of two rail elements counter to the pull-out direction is referred to as a push-in movement.

In one embodiment of the invention, the second rail element comprises a first guide element having a first deflection surface and a second guide element having a second deflection surface, wherein the first guide element is configured in such a way that, with the first guide element, a pulling force in the pull-out direction is transmittable from the second rail element to the traction element, wherein the second guide element is configured in such a way that, with the second guide element, a pulling force is transmittable from the second rail element to the traction element counter to the pull-out direction, and wherein the traction element is deflected from the first and second deflection surfaces in such a way that a displacement movement of the second rail element relative to the first rail element causes a transmission of a pulling force from the traction element to the third rail element in or counter to the pull-out direction.

In one embodiment, the first deflection surface of the first guide element has a surface normal having at least one component in the pull-out direction and the second deflection surface of the second guide element has a surface normal having at least one component counter to the pull-out direction.

In one embodiment of the invention, the first deflection surface and the second deflection surface are curved surfaces, preferably semicircularly curved surfaces, such that, when the traction element is in contact with the deflection surfaces, the traction element follows the shape of the deflection surfaces.

In one embodiment of the invention, at least the first guide element or the second guide element comprises a pair of opposing traction element guide surfaces facing each other, wherein the traction element guide surfaces are configured so as to guide the traction element in a direction perpendicular to the pull-out direction. The traction element guide surfaces serve to centre the run of the traction element and avoid a skipping of the traction element.

In one embodiment of the invention, at least the first or the second deflection surface is configured so as to deflect the traction element by 180°, wherein the deflection surface has a recess such that the traction element is engaged with the deflection surface over an angular range of less than 180°.

Such a configuration of the first or the second deflection surface or both deflection surfaces allows for an effective deflection of the traction element by 180° each time, wherein the traction element is only in frictional engagement with the respective deflection surface across a shortened surface, such that the friction forces are reduced.

In one embodiment of the invention, the recess extends over an angular range of less than 180°, preferable 120° or less, and particularly preferably 90° or less. While it is important to make the recess as large as possible in order to reduce friction, effective deflection must be ensured at the same time.

In one embodiment of the invention, the guide element is selected from a curved guide surface, a cylinder, a pin, a wheel, and a roller. Guide elements, such as wheels and rollers, that can be pivoted or rotatable relative to the second rail element reduce the friction forces that occur.

In one embodiment of the invention, the guide elements have a distance from each other that is at least as large as the maximum travel distance of the third rail element relative to the second rail element.

The traction element guide surfaces are configured so as to guide the traction element in a transverse direction, i.e., transversely to the longitudinal extension of the traction element, in order to prevent lateral sliding of the traction element against the rail element. An example of a configuration of the guide element with lateral guide surfaces is the formation of a groove, whose groove base is the respective guide surface of the guide element, so that the traction element is also guided in the transverse direction.

In one embodiment of the invention, at least the first guide element or the second guide element comprises a stationary holding portion which is fixed to the second rail element and a deflection portion which is fixed to the holding portion such that it can be moved in the pull-out direction, wherein the deflection portion comprises the deflection surface of the guide element and wherein the deflection portion is resiliently pretensioned relative to the holding portion in or counter to the pull-out direction by means of a spring element, such that the traction element is tensioned. In this way, a pre-tensioning of the traction element can be achieved with the guide element. If the traction element is pre-tensioned, this ensures a clearance-free run of the telescopic rail during pulling out and pushing in. By changing the spring force of the spring element, the movement force resulting from the friction of the traction element on the deflection surfaces can be changed.

In one embodiment of the invention, the holding portion and the deflection portion comprise a latching lug and a latching recess, wherein the latching lug and the latching recess are configured to be complementary to one another, wherein the latching lug and the latching recess are disposed on the holding portion and the deflection portion such that the latching lug and the latching recess form an end stop for a displacement movement of the deflection portion relative to the holding portion.

Such a type of snap hook and the associated undercut provides for anti-loss protection of the resiliently pretensioned guide of the traction element in a simple manner. In particular, assembly is possible by merely inserting the deflection portion into the holding portion. The deflection portion and the holding portion then lock together.

In a further embodiment of the invention, the telescopic rail comprises two traction elements, wherein the first guide element comprises two first deflection surfaces, wherein, on each of the first deflection surfaces, one of the two traction elements is deflected, wherein the second guide element comprises two second deflection surfaces, wherein, on each of the second deflection surfaces, one of the two traction elements is deflected.

In one embodiment, the first and second guide elements are each equipped with two deflection surfaces, such that the telescopic rail can be equipped with one or two traction elements, for example, depending on the expected load.

In one embodiment of the invention, the traction element has a latching projection on a surface which engages with the deflection surface. Such a projection on the traction element serves to provide, in interaction with a recess in the respective deflection surface, a latching position of the movement of the traction element relative to the deflection surfaces and thus a latching position of the rail elements in their movement relative to each other.

In one embodiment of the invention, the telescopic rail comprises a rolling element cage with rolling elements received therein and guided between the running surfaces of the second rail element and the third rail element, wherein at least the first guide element or the second guide element form a stop for a movement of the rolling element cage in or counter to the pull-out direction.

In one embodiment of the invention, the ball cage is a strip ball cage. In this way, a full utilization of the construction space within the rails can be ensured.

In an alternative embodiment, the ball cage is a ball cage having a bridge connecting the ball cage portions between the individual running surfaces of the rail elements.

In one embodiment of the invention, the first guide element and/or the second guide element comprises a clearance, up to which the first and/or the third rail element can be guided. In this way, a pre-assembly of the second rail element, i.e., the centre rail, in particular with the guide elements, is possible, while in a final assembly the first and third rail elements can be mounted without colliding with the guide elements.

While all possible drive devices are basically suitable for the displacement movement of the second rail element relative to the first rail element, in one embodiment of the invention, the drive device is selected from a spindle drive, a tooth belt drive, a rack-and-pinion drive, a flexible shaft, a push rod, a push element, a traction element, a cable pull, a gas compression spring, a hydraulic or pneumatic cylinder, and a receptacle for a linear motor or a combination thereof. In one embodiment of the invention, such a drive device can be coupled to an electric drive, so that the electric drive can itself be provided outside the telescopic rail.

In a further embodiment of the invention, the telescopic rail comprises an electric drive driving the driving device, i.e., coupled thereto. This electric drive then forms an integral part of the telescopic rail. An example of a suitable electric drive is a rotating electric motor or an electromagnetic linear drive.

In one embodiment of the invention, the drive device is a spindle drive having a threaded screw that is rotatable relative to the first rail element and fixedly mounted in the pull-out direction and an internal thread fixed in the pull-out direction on the second rail element.

The internal thread can be determined on the first or second guide element or on an additional element connected to the second rail element.

In one embodiment of the invention, the internal threads float in at least one direction perpendicular to the pull-out direction as a portion of a spindle nut. Such a floating of the internal threads of the spindle drive in a direction perpendicular to the pull-out direction serves to compensate for the tolerance clearance in the interaction of the rail elements and the threaded spindle. The spindle can thus strike more and need not be guided very precisely. A more precise bearing of the end of the threaded spindle on the second rail element is omitted.

In one embodiment of the invention, the spindle nut is mounted with the internal thread in the first or the second guide element.

In one embodiment of the invention, the internal thread floats as a portion of a spindle nut in at least one direction perpendicular to the pull-out direction with a spindle nut clearance in the first or the second guide element, wherein the threaded spindle is guided through the first or second guide element in a spindle receiving bore, wherein the threaded spindle in the spindle receiving bore comprises a spindle clearance, wherein the spindle clearance is less than or equal to the spindle nut clearance. In this way, a striking of the threaded spindle can be reduced. A centring of the threaded spindle is enabled.

In one embodiment of the invention, the internal thread is a portion of a spindle nut, wherein the spindle nut has a torque support that introduces torque that has been transmitted from the threaded spindle to the spindle nut into the first or second guide element.

In addition to receiving and introducing torques, a torque support also allows for the formation of a clear mounting orientation in order to facilitate the mounting of the telescopic rail.

In one embodiment of the invention, the spindle nut is a resiliently pretensioned clasp nut. Such a clasp nut serves as an overload protection. If the torque acting on the spindle nut is too large, the clasp nut opens counter to the spring force, and the rotational movement of the threaded spindle is no longer transmitted to the spindle nut.

In one embodiment of the invention, there is provided an electromagnetic spindle nut separation which, when unpowered, clamps the threaded spindle in order to provide a braking effect in this manner.

In one embodiment of the invention, the second rail element comprises an axial bearing for the threaded spindle. In one embodiment of the invention, the bearing is carried out in the form of a bearing plate bent out of the rail back of the first rail element. In a further embodiment, the axial bearing of the first rail element is embodied as a separate plastic part, which is connected to the second rail element.

In one embodiment of the invention, the traction element is selected from a track, a cable, a strap, and a belt or a combination thereof. In one embodiment of the invention, the traction element comprises an elastic or an inelastic material, or also a combination thereof.

In one embodiment of the invention, the traction element is a flexible belt, in particular a flexible belt having a low coefficient of friction, preferably a belt made from a spring plate.

In one embodiment, the traction element is integrally configured. In one embodiment of the invention, the traction element is an integral continuous traction element, preferably an endless belt. In a further embodiment, the traction element is integrally configured, however, two ends of the integral traction element are assembled or joined together. In one embodiment of the invention, the ends of the traction element are riveted or screwed together. In one embodiment of the invention, a spring resetting plate serves to hold the two ends of the traction element together, preferably the two ends of a belt. The traction element is enmeshed in such a spring resetting plate in the manner of a cable tie.

In an alternative embodiment of the invention, the traction element is configured in two pieces with a first traction element portion deflected by the first deflection surface and a second traction element portion deflected by the second deflection surface, wherein the first and second traction element portions are respectively fixed on the first rail element and the third rail element.

A two-piece traction element allows for a simplified fixing or mounting of the traction element on the first and the third rail elements.

In one embodiment, two fastening elements connect the first and second traction element portions to a closed traction element. The two fastening elements are fixed to the first and third rail elements, respectively. For example, lugs in the fastening elements are suspended in tappets on the first and third rail elements.

In one embodiment of the invention, the telescopic rail comprises at least one fastening element connected to the first rail element or the third rail element, wherein the fastening element comprises at least one hook, wherein at least one end of the first traction element portion and one end of the second traction element portion comprises a suspension loop, wherein the suspension loop is suspended into the hook of the fastening element. Such a configuration of the fastening element allows for a simplified mounting of the traction element.

A two-piece traction element further allows for a simple provision of the traction element in different lengths. By contrast, an integral, closed traction element is only suitable for exactly one length of the second rail element.

It is understood that in one embodiment, the division of the traction element into the first and the second traction element portions between the two fixing points is provided on the first rail element and on the third rail element.

In one embodiment of the invention, the traction element and/or its guide on at least the first, the second, or the third rail element is configured in such a way that, with the traction element, both pulling forces and pushing forces are transmittable, wherein the second rail element comprises a guide element, wherein the guide element is configured such that, with the guide element, both a pulling force and a pushing force are transmittable from the second rail element to the traction element and wherein the traction element is deflected by the guide element in such a way that both a pulling force acting on the traction element and a pushing force acting on the traction element cause a displacement movement of the third rail element in or counter to the pull-out direction relative to the second rail element. In this embodiment, the traction element can be configured open, i.e., it does not need to form a closed ring. In this way, construction space can be saved.

In one embodiment of the invention, the traction element comprises or is made of an electrically conductive material. Examples of electrically conductive materials in this sense are steel and carbon fibres. In one embodiment of the invention, the traction element consists of an electrically conductive steel sheet. In one embodiment of the invention, the traction element comprises woven or knitted plastic fibres, wherein electrically conductive wires or fibres are woven or knitted into the fabric or knitted fabric.

In one embodiment of the invention, the first and/or second guide elements also comprise at least one electrically conductive portion, wherein this electrically conductive portion is connected to the second rail element in an electrically conductive manner. In a further embodiment, the traction element comprising or made of the electrically conductive material is connected to the first and/or the third rail element in an electrically conductive manner.

In this way, an equipotential bonding among all three rail elements or also between two selected rail elements can be provided. Furthermore, it is possible to provide a power and voltage supply for consumers, such as sensors and lighting means, via the rail elements and the traction element.

When, in the sense of the present application, reference is made to a telescopic rail, this term should be generally understood to include not only rails in which the first rail element and the further rail elements have approximately the same length, but also linear guides, in which a further rail element is significantly shorter than the first rail element.

When it is stated in the present application that the telescopic rail according to the invention comprises first, second, and third rail elements, this does not exclude that the telescopic rail comprises further rail elements. In one embodiment, at least one further rail element is also synchronized with the pull-out movement of another rail element via the design according to the invention with a traction element and its guide.

In one embodiment of the invention, the first rail element of the telescopic rail is the fixed rail element, which, in the installed state, is connected to a stationary element, for example a carcass of a piece of furniture. The second and the third rail elements in such an embodiment, e.g., having a drawer, are moved relative to the stationary element.

In one embodiment of the invention, at least the first rail element or the second rail element or the third rail element is made of a material selected from a group consisting of sheet steel, aluminised sheet steel, stainless steel, aluminium, and plastic. In particular, plastic injection moulding rail elements allow the guide elements to be integrated directly into the third rail element.

In one embodiment of the invention, the first rail element comprises two running surfaces, the second rail element comprises four running surfaces, and the third rail element comprises two running surfaces, wherein a plurality of rolling elements and/or sliding bodies are disposed between the two running surfaces of the first rail element and two running surfaces of the second rail element, such that the first rail element and the second rail element are linearly displaceable in or counter to the pull-out direction and are disposed between the two running surfaces of the third rail element and two running surfaces of the second rail element, such that the third rail element and the second rail element are linearly displaceable relative to one another in a pull-out direction. In one embodiment of the invention, the first rail element, the second rail element, and the third rail element each comprise legs that support the running surfaces for the rolling elements and a back portion connecting the two legs.

Rolling elements within the meaning of the present invention can be, for example, balls or cylinders. It is understood that in one embodiment of the invention, the rolling elements are guided between the rail elements with the aid of a rolling element cage, in particular a ball cage. In one embodiment, the rolling element cage can be a split strip-shaped cage or can also be an integral cage with a back connecting the leading portions between opposing pairs of guide surfaces.

Two groups of drives are considered as the drive device for the linear displacement movement of the second rail element relative to the first rail element. On the one hand, these are drives that only provide a power support, for example by a resilient pretensioning or a pneumatic element. On the other hand, drives are considered that are connectable to an electric drive or are connected to such an electric drive in such a way that the pull-out movement and/or the push-in movement is driven by a motor.

In addition, at least one of the aforementioned problems is also solved by a pull-out assembly comprising a holding element, in particular a carcass, for example of a piece of furniture, and a receiving element, in particular a drawer, which can be moved relative to the holding element, and two telescopic rails which are disposed opposite to one another and with parallel pull-out directions, as described above in embodiments thereof, wherein the first rail element of each telescopic rail is connected to the holding element and the third rail element of each telescopic rail is connected to the receiving element.

Further advantages, features, and possible applications of the present invention will become apparent from the following description of an embodiment and the associated figures. In the figures, identical elements are identified with the same reference numerals.

Figure 15A:
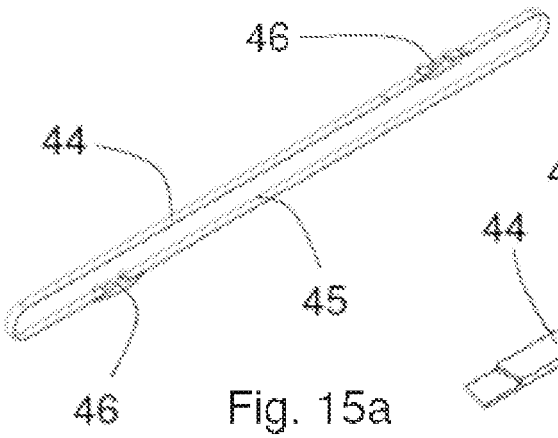
Figure 15B:
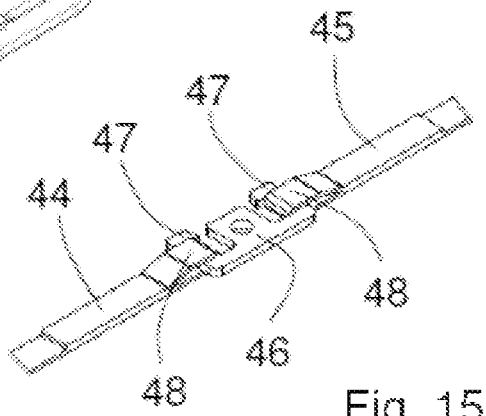

FIGS. 15*a* and 15*b* show an embodiment of a two-piece traction element.

The telescopic rails 4 discussed below with reference to the illustrations from the figures all comprise exactly three rail elements, namely a first rail element 1, a second rail element 2, and a third rail element 3. In these embodiments, the first rail element 1 forms an outer rail, the second rail element forms a centre rail, and the third rail element 3 forms an inner rail of the telescopic rail 4.

The considered embodiments of the telescopic rail 4 are fully pulled-out embodiments, i.e., the third rail element 3 can be pulled out to its full length relative to the first rail element 1, such that it no longer has an overlap with the first rail element 1 in the pull-out direction 7. In the illustrated embodiments, the first rail element 1 is a fixed rail element, for example connected to a carcass of a piece of furniture.

The rail elements 1, 2, 3 are each displaceably mounted to one another in pairs. The second rail element 2 is thus displaceably mounted on the first rail element 1, and the third rail element 3 is displaceably mounted on the second rail element 2.

In the illustrated embodiment, the centre rail element 2 consists of two rails connected to one another in a material-locking fashion at the back, each having two running surfaces.

Figure 1:
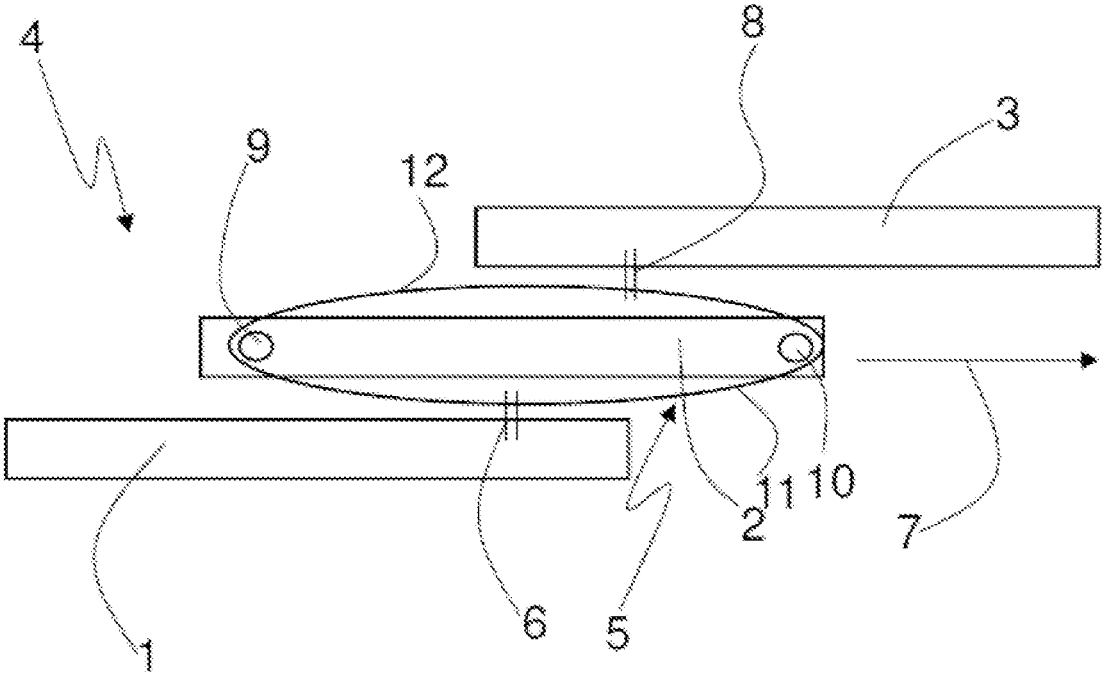
FIG. 1 is a schematic lateral view of a telescopic rail according to one embodiment of the present invention.
Figure 2:
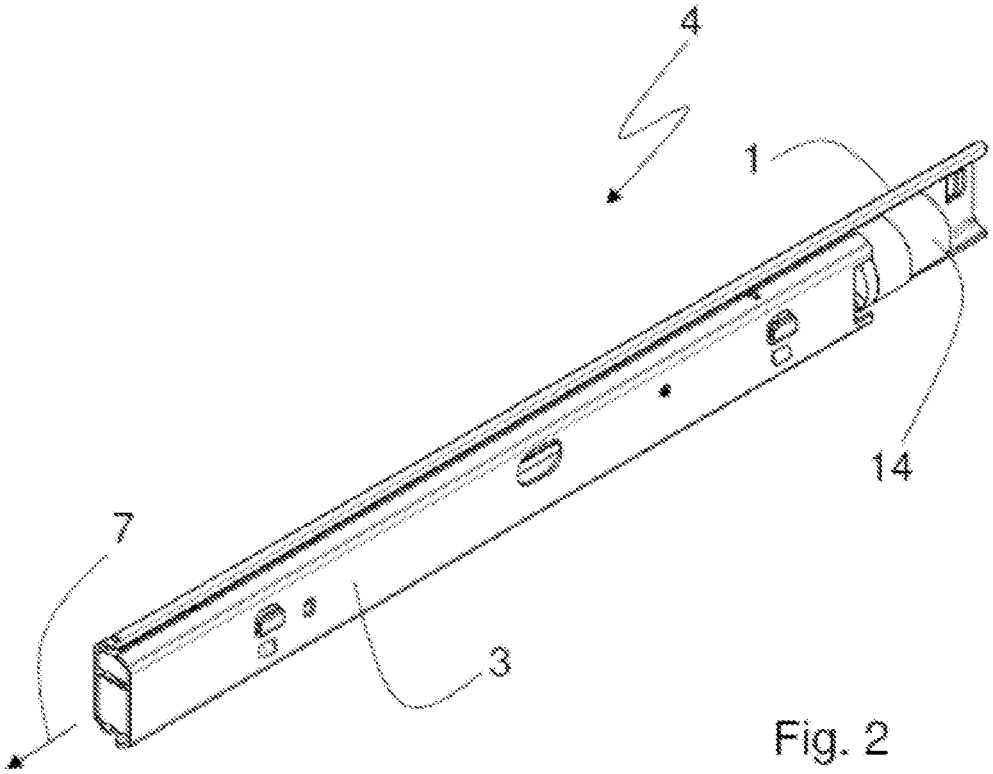
FIG. 2 is an isometric view of a telescopic rail according to one embodiment of the present invention in the fully pushed-in state.

The schematic diagram of FIG. 1 illustrates the principle underlying the invention, namely the coupling of a displacement movement of the second rail element 2 to the first rail element 1 to a displacement movement of the third rail element 3 to the second rail element 2.

For the subsequent considerations, it is initially irrelevant how the second rail element 2 is moved relative to the first rail element 1, in particular how a drive of the second rail element 2 is configured for a displacement movement of this rail element 2 relative to the first rail element 1.

The coupling between the two displacement movements is carried out via a traction element; in the embodiment shown, this is done via a transversely elastic belt 5 made of nylon. This elastic belt 5 is fixed with the aid of a rivet 6 at the front end of the first rail element 1 in the pull-out direction 7. In addition, the belt 5 is also fixed with a rivet 8 at the back end of the third rail element 3 in the pull-out direction 7.

The belt 5 is now additionally guided around two guide elements in the form of a first pin 10 and a second pin 9, which are provided so as to be stationary on the second rail element 2. In the sense of the present application, the first pin 10 forms a first guide element and the second pin 9 forms a second guide element. If the second rail element 2 is now moved in the pull-out direction 7 opposite the first rail element 1, the first pin 10 presses the belt 5 in the pull-out direction 7 and thus exerts a pulling force over the belt 5 and the rivet 8 on the third rail element 3, so that the third rail element 3 is also displaced in the pull-out direction 7 relative to the second rail element 2.

During a movement of the second rail element 2 in the pull-out direction, a first portion 11 of the belt 5, which extends from the rivet 6 on the first rail element via the first pin 10 to the rivet 8 on the third rail element 3, forms a load run 11. A second portion of the belt 5, which extends from the rivet 6 on the first rail element 1 via the second pin 9 to the rivet 8 on the third rail element 3, forms an empty drum in this direction of movement. If one reverses the direction of movement of the second rail element 2 so that it shifts counter to the pull-out direction 7 to the first rail element 1, the load run 11 becomes the empty run and the empty run 12 becomes the load run.

When the second rail element 2 is moved in the pull-out direction 7, the first pin 10 acts as a loose roll, wherein the "loose end" of the belt 5 pulls the third rail element 3 in the pull-out direction 7. If the direction of movement reverses, this consideration applies to the second pin 9.

Figure 3:
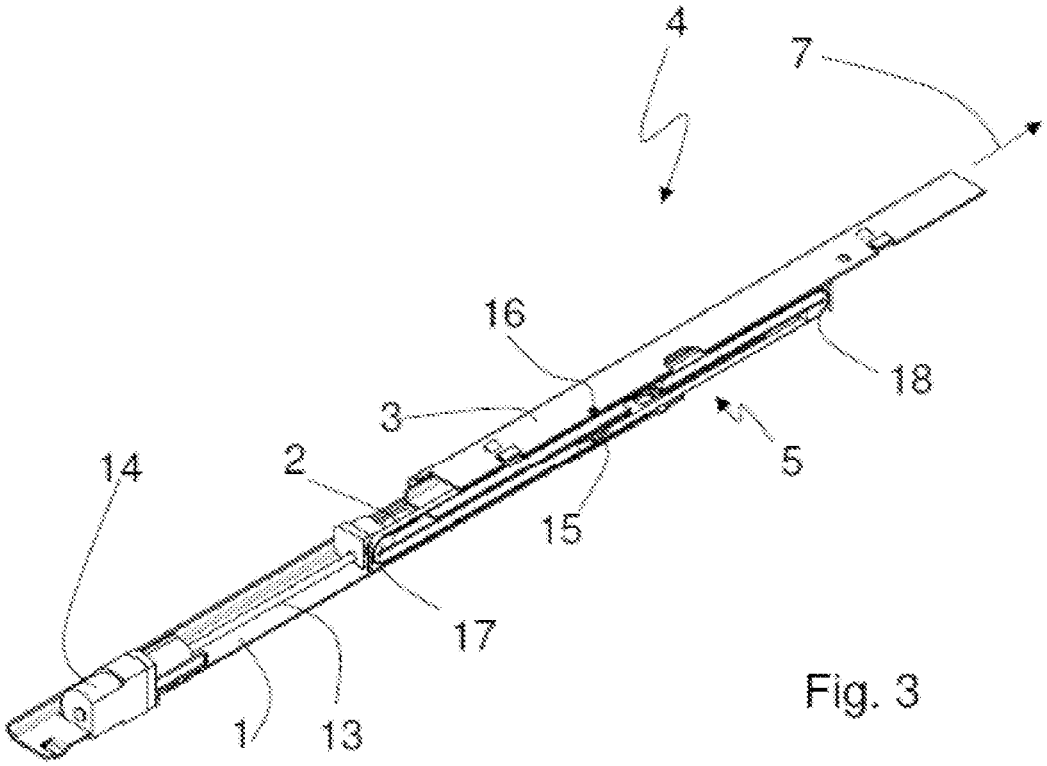
FIG. 3 is a partially broken away isometric view of the telescopic rail of FIG. 2 in the partially pulled-out state.
Figure 4:
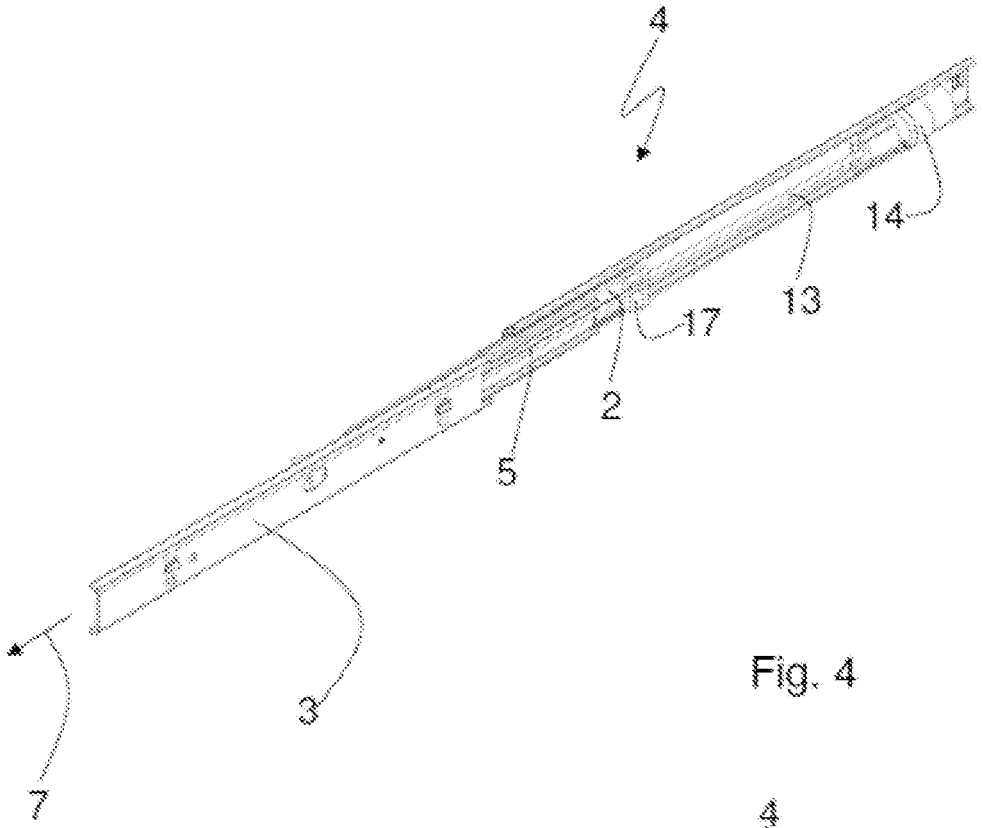
FIG. 4 is an isometric view of the telescopic rail from FIGS. 2 and 3 in the fully pulled-out state.
Figure 5:
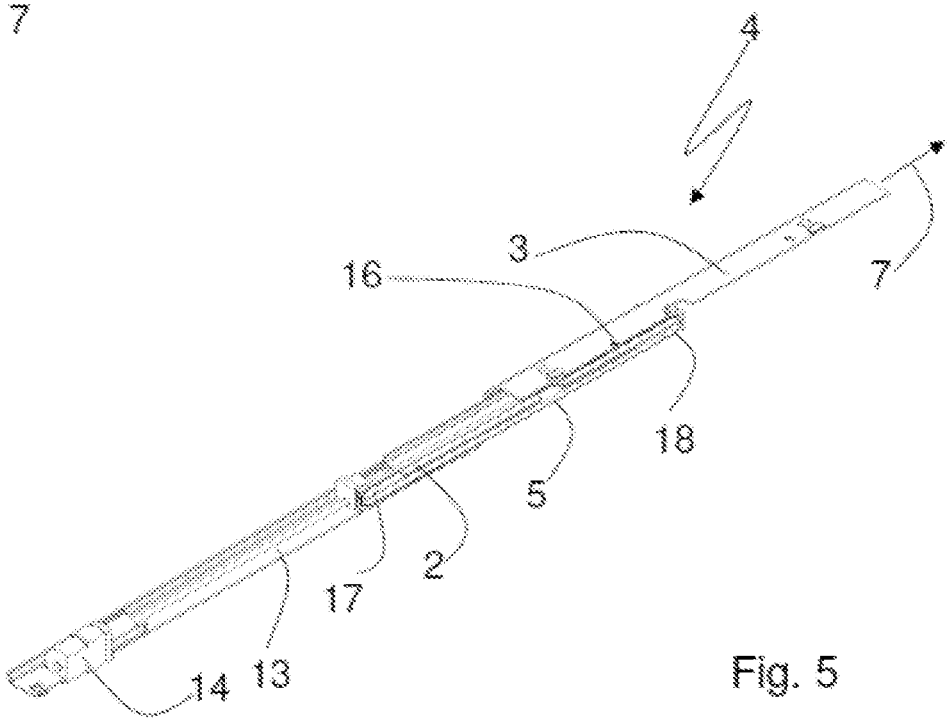
FIG. 5 is a partially broken away isometric view of the telescopic rail from FIGS. 2 to 4 in the fully pulled-out state.
Figure 6:
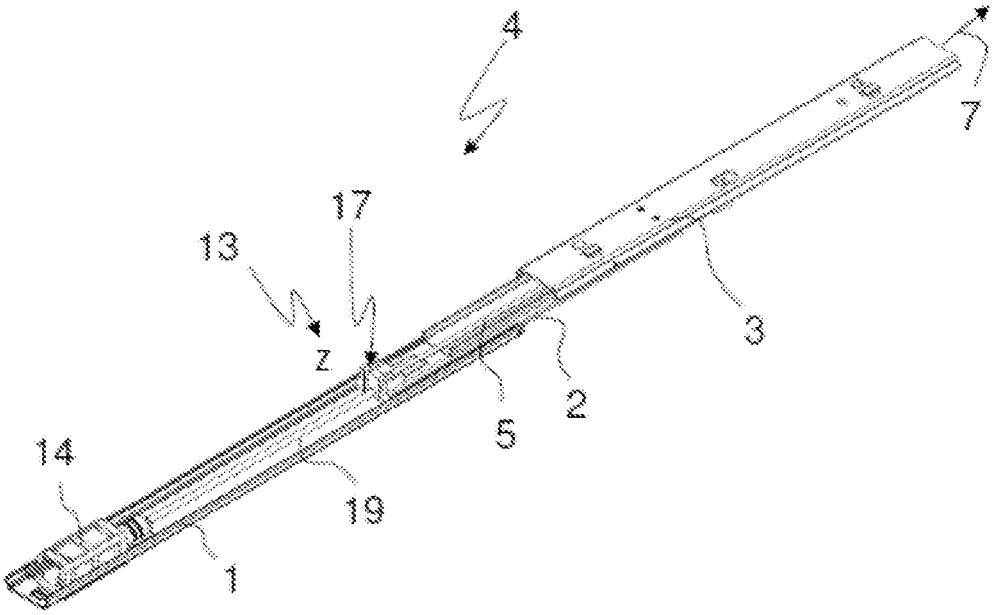
FIG. 6 is an isometric view of a partially pulled-out embodiment of a telescopic rail according to a further embodiment of the present invention.

FIGS. 3 to 5 now show isometric views of a telescopic rail 4, which realizes the design principle previously described based on the schematic of FIG. 1.

In this embodiment, the centre rail 2 is displaceable relative to the first rail element 1 in and counter to the pull-out direction 7 with the aid of a spindle drive 13 in a motor-driven manner. The threaded spindle of the spindle drive 13 is mounted on the first rail element 1 and engages a spindle nut fixed on the second rail element 2, such that when the spindle rotates, the second rail element is displaced relative to the first rail element. In the illustrated embodiment, the spindle nut is fixed in and counter to the pull-out direction 7 on the second rail element, but floats in the transverse direction perpendicular to the pull-out direction 7, i.e., with a clearance, in order to be able to accommodate tolerances in the transverse direction. The spindle is in turn coupled to an electric motor 14 so that the pull-out and push-in movement of the telescopic rail 4 is motor-driven.

In the illustrations of FIGS. 4 and 5, the telescopic rail 4 is shown placed on the first rail element 1, wherein the upper part of the telescopic rail 4 is shown broken away in FIGS. 3 and 4. A look into the interior of the second rail element 2 is thus possible.

Inside, a belt of nylon can be seen as a traction element 5, which is fixed at the points marked with reference numerals 15 and 16 on the first 1 and third 3 rail elements, respectively. If the spindle drive 13 now moves the second rail element 2 in the pull-out direction 7, this displacement movement leads to a pull on the belt 5, so that the third rail element 3 is also displaced in the pull-out direction relative to the second rail element 2.

In FIG. 5, in particular, the two guide elements 17, 18 disposed on the second rail element 2 can be seen. Like the pins 9, 10, the function of which has previously been described for the schematic of FIG. 1, these guide the belt-shaped traction element 5 and support the traction element 5 in a direction parallel to the pull-out direction 7. In this way, forces acting on the second rail element 2 in a direction parallel to the pull-out direction 7 can be transmitted to the traction element 5.

FIGS. 6 to 13 show various aspects of a further embodiment of the telescopic rail 4. This telescopic rail 4 also consists of a first stationary rail element 1, a second central rail element 2, and a third rail element 3. The three rail elements 1, 2, 3 form a fully telescopic extractor.

In this embodiment, as well, the drive of a pull-out or push-in movement of the second rail element 2 occurs relative to the first rail element 1 with the aid of a spindle drive 13. The spindle drive 13 comprises a threaded spindle 19, a spindle nut 20, and an electric motor 14. The pull-out or push-in movement of the third rail element 3 relative to the first rail element 1, which is synchronized to the pull-out or push-in movement of the second rail element 2, occurs with the aid of a belt 5 as a traction element, as in the previously described embodiments.

Figure 7:
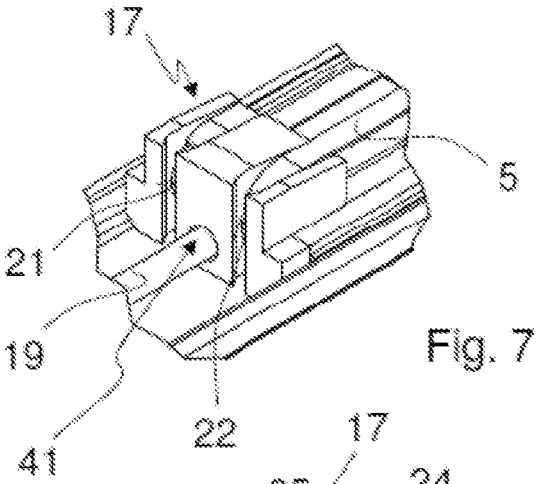
FIG. 7 is a partially broken away, enlarged isometric view of the first guide element of the telescopic rail of FIG. 6.
Figure 8:
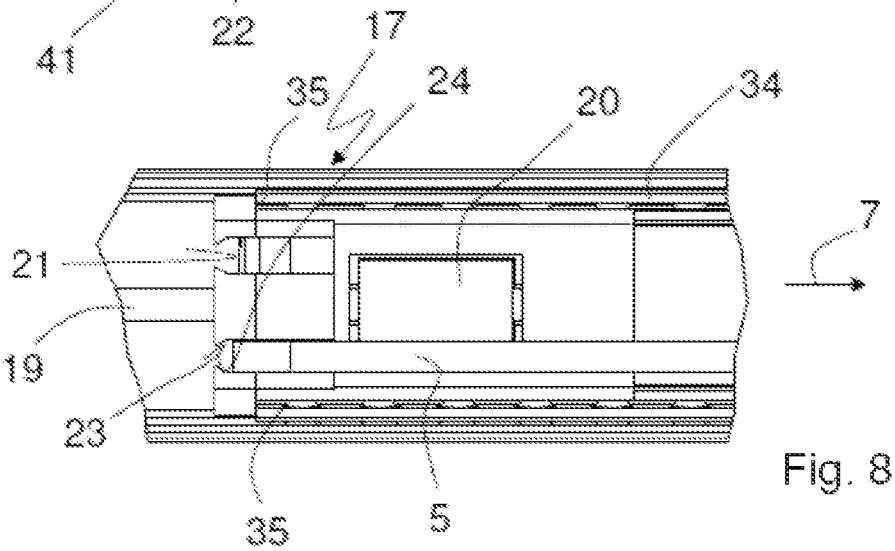
FIG. 8 is a partially broken away, enlarged top plan view of the first guide element of FIG. 7.
Figure 9:
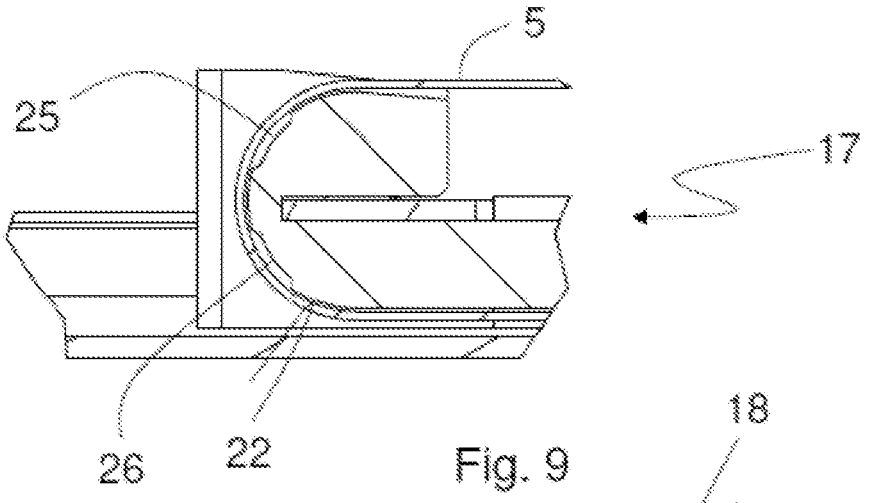
FIG. 9 is a partially broken away, enlarged partial sectional view of the first guide element of FIGS. 7 and 8.
Figure 10:
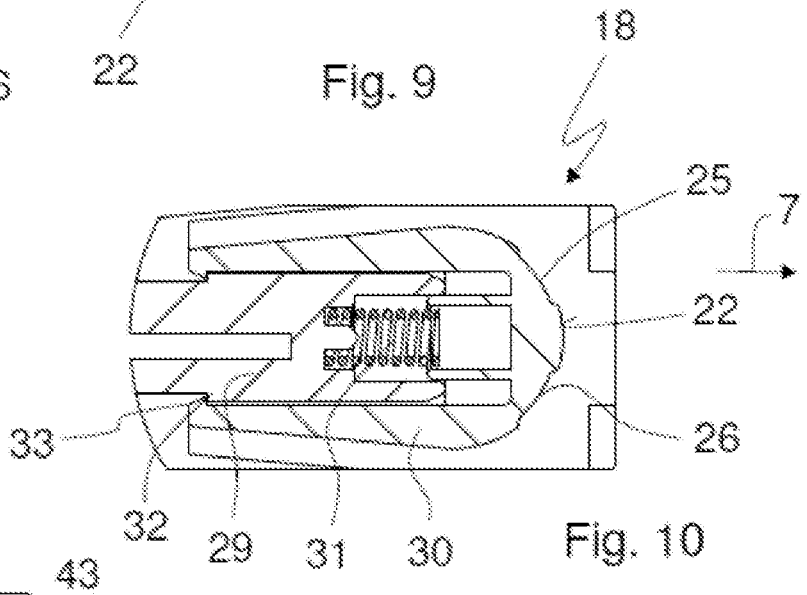
FIG. 10 is a partially broken away, enlarged partial sectional view of the second guide element of the telescopic rail from FIGS. 6 to 9.

To guide the belt 5, the embodiment of the telescopic rail 4 from FIGS. 6-13 also comprises two guide elements 17, 18. The first guide element 17 is shown enlarged in FIGS. 7-9. As can be seen in FIGS. 7 and 8, the first guide element 17 comprises two first deflection surfaces 21, 22. In this way, two traction elements can be guided with the first guide element in order to adapt the telescopic rail 4 to various load cases. In the illustrated embodiment, only one belt 5 for synchronizing the pull-out or push-in movement of the third rail element 3 is received on the two guide elements 17, 18.

In the illustrations of FIGS. 7 and 8, it can be seen that the belt 5 on the first guide element 17, in addition to the deflection surface 22, is also guided laterally with the aid of two traction element guide surfaces 23, 24, which face each other. These lateral traction element guide surfaces 23, 24 prevent skipping or jumping of the belt 5 from the respective deflection surface 21, 22. In addition, the traction element guide surfaces 23, 24 centre the run of the belt 5 on the respective deflection surface 21, 22.

Each of the deflection surfaces 21, 22 causes a deflection of the belt 5 by 180°, wherein 180° is the looping angle of the belt. However, the deflection surfaces 21, 22 each have two recesses 25, 26. These recesses 25, 26 reduce the support surface of the belt 5 on the respective deflection surface 21, 22, so that the friction between the belt 5 and the respective deflection surface 22 is reduced. The recesses 25, 26 shown extend over an angular range of less than 90°, respectively.

Figure 14:
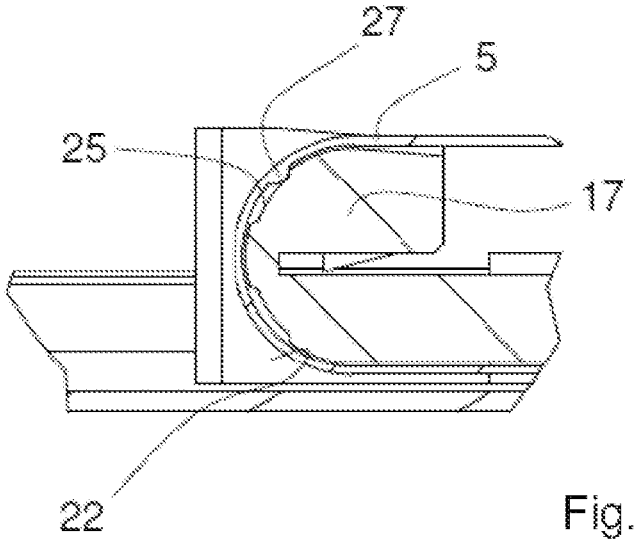
FIG. 14 is a partially broken away, sectional view of an alternative embodiment of the traction element.

The recesses 25, 26 can also provide a latching function, as shown schematically in FIG. 14. In this variant, the traction element 5 comprises a latching projection 27 on its inner surface 28. This latching projection snaps into place upon reaching one of the recesses 25, 26 and positions the belt 5 and thus the pull-out movement of the third rail element 3 relative to the second rail element 2 at a position predetermined by the position of the latching projection 27 on the belt 5.

It is understood that the second guide element 18 is configured so as to correspond to the first guide element 17. The second guide element 18 also has two deflection surfaces 21, 22, which likewise cause a deflection of the traction element 5 by 180°. This can be seen from the sectional view of FIG. 10.

In the illustrated embodiment of the second guide element 18, it is configured in two parts. The guide element 18 includes a holding portion 29 and a deflection portion. The holding portion 29 is stationarily connected to the second rail element 2, while the deflection portion 30 is displaceably mounted on the holding portion 29 in the pull-out direction. The deflection portion 30 supports the deflection surfaces 21, 22. A spiral spring 31 as a spring element within the meaning of the present application resiliently pretensions the deflection portion 30 in the pull-out direction 7. In this way, the spring 31 keeps the traction element 5 tight under pulling stress. This reduces the clearance of the traction element 5 relative to the three rail elements 1, 2, 3 and thus reduces the clearance of the pull-out movements of the rail elements relative to one another. The movement of the deflection portion 30 under pretensioning is limited by a stopping surface 32 on the holding portion 29, wherein the deflection portion 30 comprises a hook 33, which is configured so as to engage with and abut against the stopping surface 32. The combination of the stopping surface 32 and the hook 33 also serves for simple mounting of the deflection portion on the holding portion. The deflection portion 30 is pushed onto the holding portion 29 and is locked as soon as the axial position of the hook 33 has passed the stopping surfaces 32.

In the illustrated embodiment, a rolling element cage 34 in the form of a strip ball cage 34 is provided between two rail elements 1, 2, 3, respectively. The first guide element 17 also forms a stop for two strip ball cages 34, which are disposed between the second rail element 2 and the third rail element 3.

The first guide element 17 also serves to mount the spindle nut 20 on the second rail element 2. This reduces the number of necessary components at and connections to the second rail element 2. The spindle nut 20 supports an internal thread 38, which engages with the threaded spindle 19. The spindle nut 20 is received in the first guide element 17 such that it is fixed in and counter to the pull-out direction such that a rotational movement of the threaded spindle 19 fixedly mounted on the first rail element leads to a linear movement of the spindle nut 20 and thus of the second rail element 2 relative to the first rail element 1.

Figure 12:
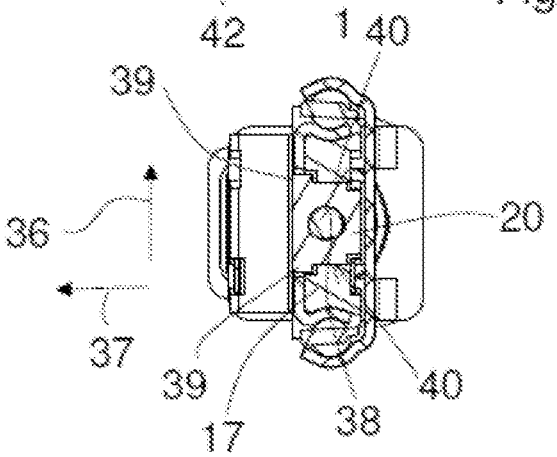
FIG. 12 is a sectional view of the telescopic rail from FIG. 6 in the region of the spindle nut.

By contrast, the spindle nut 20 floats in all directions perpendicular to the pull-out direction 7 on the first guide element 17. Thus, a striking of the threaded spindle 19 against the rail elements is equalized and does not lead to a vibration of the rail elements 1, 2, 3. FIG. 12 shows the bearing of the threaded spindle 20 in the first guide element 17 in a cross-sectional view. When viewed in this manner, the spindle nut 20 floats in both a vertical direction 36 as well as a transverse direction 37.

The spindle nut 20 is further configured so as to comprise torque supports in the form of projections 39 on two sides. These introduce the torques that have been transmitted from the threaded spindle 19 to the spindle nut 20 into the first guide element 17. Thus, the torques do not need to be transmitted exclusively over the lateral surfaces 40 of the spindle nut. The rail is thus also usable for higher load cases.

The projections 39 not only serve to form torque supports, but also provide a clear assembly orientation that prevents an incorrect mounting of the spindle nut 20.

In FIG. 7, it can be seen that the threaded spindle 19 is passed through the first guide element 17 via a spindle receiving bore 41, in order to engage the spindle nut 20. The spindle receiving bore 41 is sized such that the clearance of the threaded spindle 19 in the spindle receiving bore 41 is smaller than the clearance of the spindle nut 20 in the vertical direction 36 and the transverse direction 37.

Figure 11:
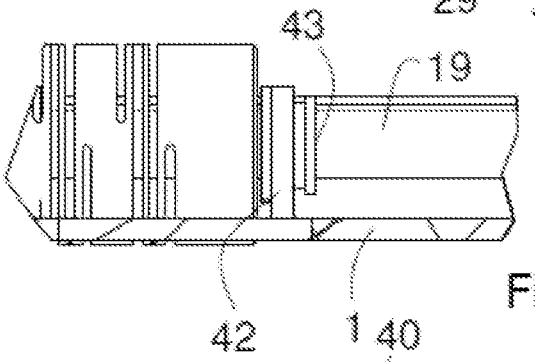
FIG. 11 is a partially broken away, enlarged lateral view of the bearing of the threaded spindle of the telescopic rail from FIGS. 6 to 10.

FIG. 11 shows the bearing of the motor-side end of the threaded spindle 19 on the first rail element 1. This mounting is carried out in the axial direction, i.e., in the pull-out direction, with the aid of a tab 42, which is bent out of the rail back of the first rail element 1, wherein a hollow cylindrical bearing bushing 43 for guiding the spindle 19 is received in this tab 42.

Figure 13:
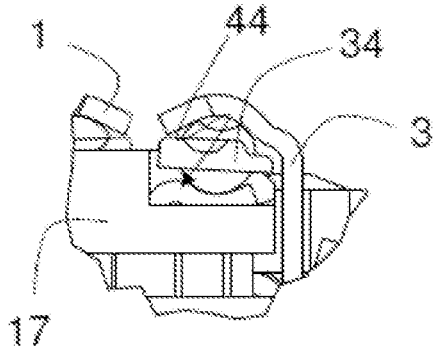
FIG. 13 is a partially broken away, sectional view of the telescopic rail from FIG. 6 in the region of the first guide element.

FIG. 13 clarifies that the guide element 17 has a clearance 44, which allows the third rail element 3 to be mounted on the second rail element 2, which is fully equipped with the guide elements, without a collision of the third rail element 3 against the guide element 17.

FIGS. 15*a* and 15*b* show a two-piece configuration of a belt-shaped traction element 5, wherein the two traction element portions 44, 45 are each connected at their two ends. A fastening element 46 having two hooks 47 serves as the connector for the ends. A suspension loop 48 is provided at each end of the two traction element portions 44, 45 and is suspended in the respective hook 47 of the fastening element 46. The fastening element 46 also comprises a bore, through which a rivet is hit in order to connect the fastening element 46 to the first rail element 1 and the third rail element 3, respectively.

For the purpose of the original disclosure, it should be noted that all of the features as they become apparent to a person skilled in the art from the present description, the drawings and the claims, even if they have been specifically described only in connection with specific other features, can be combined both individually and in any combination with other features or groups of features disclosed here, insofar as this has not been expressly excluded or technical circumstances make such combinations impossible or pointless. A comprehensive, explicit presentation of all conceivable combinations of features is omitted here solely for the sake of brevity and legibility of the description.

Although the invention has been presented and described in detail in the drawings and the foregoing description, this representation and description is merely an example and is not intended to limit the scope of protection as defined by the claims. The invention is not limited to the disclosed embodiments.

Modifications of the disclosed embodiments will be obvious to those skilled in the art from the drawings, the description and the appended claims. In the claims, the word "comprise" does not exclude other elements or steps, and the indefinite article "a" does not exclude a plurality. The mere fact that certain features are claimed in different claims does not preclude their combination. Reference numerals in the claims are not intended to limit the scope of protection.

LIST OF REFERENCE NUMERALS

1 First rail element
2 Second rail element
3 Third rail element
4 Telescopic rail
5 Belt as traction element
6, 8 Rivet
7 Pull-out direction
9, 10 Pin
11 Load run
12 Empty run
13 Spindle drive
14 Electric motor
15 Fixing point of the belt 5 on the first rail element 1
16 Fixing point of the belt 5 on the third rail element 3
17, 18 Guide element
19 Threaded spindle
20 Spindle nut
21, 22 Deflection surface
23, 24 Traction element guide surfaces
25, 26 Recess
27 Latching projection of the traction element 5
28 Inner surface of the traction element 5
29 Holding portion
30 Deflection portion
31 Spiral spring
32 Stopping surface
33 Hook
34 Strip ball cage
35 Stop
36 Vertical direction
37 Transverse direction
38 Internal thread
39 Projection
40 Lateral surface of the spindle nut
41 Spindle receiving bore
42 Tab for guiding the threaded spindle
43 Bearing bushing
44, 45 Traction element portion
46 Fastening element
47 Hook
48 Suspension loop

The invention claimed is:

1. A telescopic rail (4) comprising
a first rail element (1),
a second rail element (2),
a third rail element (3), and
a drive device (13),
wherein the first rail element (1) and the second rail element (2) are mounted together such that the first rail element (1) and the second rail element (2) are linearly displaceable relative to one another in and counter to a pull-out direction (7);
wherein the third rail element (3) and the second rail element (2) are mounted together such that the third rail element (3) and the second rail element (2) are linearly displaceable relative to one another in and counter to the pull-out direction (7),
wherein the drive device (13) is mounted on the first rail element (1) or is mountable on a holding element connectable to the first rail element;
wherein the drive device (13) is configured such that, in an operation of the telescopic rail (4), the drive device (13) causes a linear movement of the second rail element (2) relative to the first rail element (1) in or counter to the pull-out direction (7),
characterised in that the telescopic rail (4) comprises a traction element (5),
wherein the traction element (5) is fixed to the first rail element (1) and to the third rail element (3);
wherein the traction element (5) is guided on the second rail element (2) in a direction parallel to the pull-out direction (7) such that a displacement movement of the second rail element (2) relative to the first rail element (1) leads to a displacement movement of the third rail element (3) relative to the second rail element (2); and
wherein the drive device (13) is a spindle drive (13) comprising a threaded spindle (19) which is rotatable relative to the first rail element (1) and is stationarily mounted in the pull-out direction (7) and an internal thread (38) which is fixed on the second rail element (1) in the pull-out direction (7).

2. The telescopic rail (4) according to claim 1,
characterized in that the second rail element (2) comprises a first guide element (10, 18) having a first deflection surface (21, 22) and a second guide element (9, 17) having a second deflection surface (21, 22),
wherein the first guide element (10, 18) is configured such that a pulling force in the pull-out direction (7) can be transmitted from the second rail element (2) to the traction element (5) by means of the first guide element (10, 18),
wherein the second guide element (9, 17) is configured such that a pulling force counter to the pull-out direction (7) can be transmitted from the second rail element (2) to the traction element (5) by means of the second guide element (9, 17), and
wherein the traction element (5) is deflected by the first and second deflection surfaces (21, 22) such that a displacement movement of the second rail element (2) relative to the first rail element (1) causes a transmission of a pulling force from the traction element (5) to the third rail element (3) in or counter to the pull-out direction.

3. The telescopic rail (4) according to claim 2, characterised in that at least the first guide element (10, 18) or the second guide element (9, 17) comprises a pair of oppositely disposed traction element guide surfaces (23, 24) which face one another, wherein the traction element guide surfaces (23, 24) are configured such that they guide the traction element (5) in a direction perpendicular to the pull-out direction (7).

4. The telescopic rail (4) according to claim 2, characterised in that the telescopic rail (4) comprises a rolling element cage with rolling elements received therein and guided between the running surfaces of the second rail element (2) and the third rail element (3), wherein at least the first guide element (1) or the second guide element (2) forms a stop (35) for a movement of the rolling element cage (34) in or counter to the pull-out direction (7).

5. The telescopic rail (4) according to claim 2, characterised in that the traction element (5) is configured in two parts with a first traction element portion (11) guided around the first guide element (10, 18) and a second traction element portion (12) guided around the second guide element (9, 17), wherein the first and the second traction element portion (11, 12) are respectively fixed on the first rail element (1) and the third rail element (3).

6. The telescopic rail (4) according to claim 1, characterised in that the internal thread (38) is mounted as a portion of a spindle nut (20) in the first or second guide element (1, 2) such that it floats in at least one direction perpendicular to the pull-out direction (7) with a nut clearance, wherein the threaded spindle (19) is guided through the guide element (17, 18) in a spindle receiving bore (41), wherein the threaded spindle (19) in the spindle receiving bore (41) has a spindle clearance and wherein the spindle clearance is less than or equal to the nut clearance.

7. The telescopic rail (4) according to claim 1, characterised in that the internal thread (38) is a portion of a spindle nut (20), wherein the spindle nut (20) comprises a torque arm (41) which introduces torque transmitted from the threaded spindle (19) to the spindle nut (20) into the first or second guide element (17, 18).

8. The telescopic rail (4) according to claim 1 characterised in that the spindle nut (20) is a clasp nut as an overload protection.

9. The telescopic rail (4) according to claim 1, characterised in that the second rail element (2) comprises an axial bearing for the threaded spindle (19).

10. The telescopic rail (4) according to claim 9 wherein the axial bearing preferably comprises a bearing plate (42) bent out of a rail back of the first rail element (1).

11. The telescopic rail (4) according to claim 1, characterised in that the traction element (5) is configured such that both pulling forces and pushing forces can be transmitted by means of the traction element (5), wherein the second rail element (2) comprises a guide element (17, 18), wherein the guide element (17, 18) is configured such that a pulling force and a pushing force can be transmitted from the second rail element (2) to the traction element (5) by means of the guide element (17, 18), and wherein the traction element (5) is deflected by the guide element (17, 18) such that both a pulling force acting on the traction element (5) and a pushing force acting on the traction element (5) causes a displacement movement of the third rail element (3) in or counter to the pull-out direction (7) relative to the second rail element (2).

12. The telescopic rail (4) according to claim 1, wherein the internal thread (38) is mounted as a portion of a spindle nut (20) such that it floats in at least one direction perpendicular to the pull-out direction (7).

13. A telescopic rail (4) comprising a first rail element (1), a second rail element (2), a third rail element (3), and a drive device (13), wherein the first rail element (1) and the second rail element (2) are mounted together such that the first rail element (1) and the second rail element (2) are linearly displaceable relative to one another in and counter to a pull-out direction (7);

wherein the third rail element (3) and the second rail element (2) are mounted together such that the third rail element (3) and the second rail element (2) are linearly displaceable relative to one another in and counter to the pull-out direction (7);

wherein the drive device (13) is mounted on the first rail element (1) or is mountable on a holding element connectable to the first rail element;

wherein the drive device (13) is configured such that, in an operation of the telescopic rail (4), the drive device (13) causes a linear movement of the second rail element (2) relative to the first rail element (1) in or counter to the pull-out direction (7);

wherein the telescopic rail (4) comprises a traction element (5);

wherein the traction element (5) is fixed to the first rail element (1) and to the third rail element (3);

wherein the traction element (5) is guided on the second rail element (2) in a direction parallel to the pull-out direction (7) such that a displacement movement of the second rail element (2) relative to the first rail element (1) leads to a displacement movement of the third rail element (3) relative to the second rail element (2);

wherein the second rail element (2) comprises a first guide element (10, 18) has a first deflection surface (21, 22) and a second guide element (9, 17) has a second deflection surface (21, 22), wherein the first guide element (10, 18) is configured such that a pulling force in the pull-out direction (7) can be transmitted from the second rail element (2) to the traction element (5) by means of the first guide element (10, 18), wherein the second guide element (9, 17) is configured such that a pulling force counter to the pull-out direction (7) can be transmitted from the second rail element (2) to the traction element (5) by means of the second guide element (9, 17);

wherein the traction element (5) is deflected by the first and second deflection surfaces (21, 22) such that a displacement movement of the second rail element (2) relative to the first rail element (1) causes a transmission of a pulling force from the traction element (5) to the third rail element (3) in or counter to the pull-out direction;

wherein at least the first or the second deflection surface (21, 22) is configured such that the first or the second deflection surface (21, 22) deflects the traction element by 180°; and wherein the deflection surface (21, 22) comprises a recess (25, 26), so that the traction element (5) is in frictional engagement with the deflection surface (21, 22) over an angular range of less than 180°.

14. The telescopic rail (4) according to claim 13, characterised in that at least the first guide element (10, 18) or the second guide element (9, 17) comprises a pair of oppositely disposed traction element guide surfaces (23, 24) which face one another, wherein the traction element guide surfaces (23, 24) are configured such that they guide the traction element (5) in a direction perpendicular to the pull-out direction (7).

15. The telescopic rail (4) according to claim 13, characterised in that the traction element (5) comprises a latching projection (27) on a surface (28) which comes into frictional engagement with the deflection surface (21, 22).

16. The telescopic rail (4) according to claim 13, characterised in that the telescopic rail (4) comprises a rolling element cage with rolling elements received therein and guided between the running surfaces of the second rail element (2) and the third rail element (3), wherein at least the first rail element (1) or the second rail element (2) forms a stop (35) for a movement of the rolling element cage (34) in or counter to the pull-out direction (7).

17. The telescopic rail (4) according to claim 13, characterised in that the traction element (5) is configured in two parts with a first traction element portion (11) guided around the first guide element (10, 18) and a second traction element portion (12) guided around the second guide element (9, 17), wherein the first and the second traction element portion (11, 12) are respectively fixed on the first rail element (1) and the third rail element (3).

18. The telescopic rail (4) according to claim 13, characterised in that the traction element (5) is configured such that both pulling forces and pushing forces can be transmitted by means of the traction element (5), wherein the second rail element (2) comprises a guide element (17, 18), wherein the guide element (17, 18) is configured such that a pulling force and a pushing force can be transmitted from the second rail element (2) to the traction element (5) by means of the guide element (17, 18), and wherein the traction element (5) is deflected by the guide element (17, 18) such that both a pulling force acting on the traction element (5) and a pushing force acting on the traction element (5) causes a displacement movement of the third rail element (3) in or counter to the pull-out direction (7) relative to the second rail element (2).

19. A pull-out assembly comprising a holding element and a receiving element, which can be moved relative to the holding element, and two telescopic rails (4) which are disposed opposite to one another and with parallel pull-out directions (7), wherein a first rail element (1) of each telescopic rail (4) is connected to the holding element and a third rail element (3) of each telescopic rail (4) is connected to the receiving element, wherein each of the two telescopic rails comprises:

a first rail element (1), a second rail element (2), a third rail element (3), and a drive device (13), wherein the first rail element (1) and the second rail element (2) are mounted together such that the first rail element (1) and the second rail element (2) are linearly displaceable relative to one another in and counter to a pull-out direction (7);

wherein the third rail element (3) and the second rail element (2) are mounted together such that the third rail element (3) and the second rail element (2) are linearly displaceable relative to one another in and counter to the pull-out direction (7);

wherein the drive device (13) is mounted on the first rail element (1) or is mountable on a holding element connectable to the first rail element;

wherein the drive device (13) is configured such that, in an operation of the telescopic rail (4), the drive device (13) causes a linear movement of the second rail element (2) relative to the first rail element (1) in or counter to the pull-out direction (7);

wherein the telescopic rail (4) comprises a traction element (5);

wherein the traction element (5) is fixed to the first rail element (1) and to the third rail element (3);

wherein the traction element (5) is guided on the second rail element (2) in a direction parallel to the pull-out direction (7) such that a displacement movement of the second rail element (2) relative to the first rail element (1) leads to a displacement movement of the third rail element (3) relative to the second rail element (2);

wherein the second rail element (2) comprises a first guide element (10, 18) which has a first deflection surface (21, 22) and a second guide element (9, 17) has a second deflection surface (21, 22), wherein the first guide element (10, 18) is configured such that a pulling force in the pull-out direction (7) can be transmitted from the second rail element (2) to the traction element (5) by means of the first guide element (10, 18), wherein the second guide element (9, 17) is configured such that a pulling force counter to the pull-out direction (7) can be transmitted from the second rail element (2) to the traction element (5) by means of the second guide element (9, 17);

wherein the traction element (5) is deflected by the first and second deflection surfaces (21, 22) such that a displacement movement of the second rail element (2) relative to the first rail element (1) causes a transmission of a pulling force from the traction element (5) to the third rail element (3) in or counter to the pull-out direction (7).

20. A pull-out assembly according to claim 19 wherein the holding element comprises a carcass and the receiving element comprises a drawer.

21. A telescopic rail (4) comprising a first rail element (1), a second rail element (2), a third rail element (3), and a drive device (13), wherein the first rail element (1) and the second rail element (2) are mounted together such that the first rail element (1) and the second rail element (2) are linearly displaceable relative to one another in and counter to a pull-out direction (7);

wherein the third rail element (3) and the second rail element (2) are mounted together such that the third rail element (3) and the second rail element (2) are linearly displaceable relative to one another in and counter to the pull-out direction (7);

wherein the drive device (13) is mounted on the first rail element (1) or is mountable on a holding element connectable to the first rail element;

wherein the drive device (13) is configured such that, in an operation of the telescopic rail (4), the drive device (13) causes a linear movement of the second rail element (2) relative to the first rail element (1) in or counter to the pull-out direction (7);

wherein the telescopic rail (4) comprises a traction element (5);

wherein the traction element (5) is fixed to the first rail element (1) and to the third rail element (3);

wherein the traction element (5) is guided on the second rail element (2) in a direction parallel to the pull-out direction (7) such that a displacement movement of the second rail element (2) relative to the first rail element (1) leads to a displacement movement of the third rail element (3) relative to the second rail element (2);

wherein the second rail element (2) comprises a first guide element (10, 18) which has a first deflection surface (21, 22) and a second guide element (9, 17) has a second deflection surface (21, 22), wherein the first guide element (10, 18) is configured such that a pulling force in the pull-out direction (7) can be transmitted from the second rail element (2) to the traction element (5) by means of the first guide element (10, 18), wherein the second guide element (9, 17) is configured such that a pulling force counter to the pull-out direction (7) can be transmitted from the second rail element (2) to the traction element (5) by means of the second guide element (9, 17);

wherein the traction element (5) is deflected by the first and second deflection surfaces (21, 22) such that a displacement movement of the second rail element (2) relative to the first rail element (1) causes a transmission of a pulling force from the traction element (5) to the third rail element (3) in or counter to the pull-out direction;

wherein at least the first guide element (10, 18) or the second guide element (9, 17) comprises a stationary holding portion (29) which is fixed to the second rail element (2) and a deflection portion (30) which is fixed to the holding portion (29) such that it can be moved in the pull-out direction (7), wherein the deflection portion (30) comprises the deflection surface (21, 22) of the guide element (9, 17) and wherein the deflection portion (30) is resiliently pretensioned relative to the holding portion (29) in or counter to the pull-out direction (7) by means of a spring element (31), such that the traction element (5) is tensioned.

22. The telescopic rail (4) according to claim 21, characterized in that the second rail element (2) comprises a first guide element (10, 18) having a first deflection surface (21) and a second guide element (9, 17) having a second deflection surface (22), wherein the first guide element (10, 18) is configured such that a pulling force in the pull-out direction (7) can be transmitted from the second rail element (2) to the traction element (5) by means of the first guide element (10, 18), wherein the second guide element (9, 17) is configured such that a pulling force counter to the pull-out direction (7) can be transmitted from the second rail element (2) to the traction element (5) by means of the second guide element (9, 17), and wherein the traction element (5) is deflected by the first and second deflection surfaces (21, 22) such that a displacement movement of the second rail element (2) relative to the first rail element (1) causes a transmission of a pulling force from the traction element (5) to the third rail element (3) in or counter to the pull-out direction.

23. The telescopic rail (4) according to claim 22, characterised in that at least the first guide element (10, 18) or the second guide element (9, 17) comprises a pair of oppositely disposed traction element guide surfaces (23, 24) which face one another, wherein the traction element guide surfaces (23, 24) are configured such that they guide the traction element (5) in a direction perpendicular to the pull-out direction (7).

24. The telescopic rail (4) according to claim 22, characterised in that the telescopic rail (4) comprises a rolling element cage with rolling elements received therein and guided between the running surfaces of the second rail element (2) and the third rail element (3), wherein at least the first guide element (10, 18) or the second guide element (9, 17) forms a stop (35) for a movement of the rolling element cage (34) in or counter to the pull-out direction (7).

25. The telescopic rail (4) according to claim 22, characterised in that the traction element (5) is configured in two parts with a first traction element portion (11) guided around the first guide element (10, 18) and a second traction element portion (12) guided around the second guide element (9, 17), wherein the first and the second traction element portion (11, 12) are respectively fixed on the first rail element (1) and the third rail element (3).

26. The telescopic rail (4) according to claim 21, characterised in that the traction element (5) is configured such that both pulling forces and pushing forces can be transmitted by means of the traction element (5), wherein the second rail element (2) comprises a guide element (17, 18), wherein the guide element (17, 18) is configured such that a pulling force and a pushing force can be transmitted from the second rail element (2) to the traction element (5) by means of the guide element (17, 18), and wherein the traction element (5) is deflected by the guide element (17, 18) such that both a pulling force acting on the traction element (5) and a pushing force acting on the traction element (5) causes a displacement movement of the third rail element (3) in or counter to the pull-out direction (7) relative to the second rail element (2).

* * * * *